US005397261A

United States Patent [19]

Malewicki et al.

[11] Patent Number: 5,397,261

[45] Date of Patent: Mar. 14, 1995

[54] COMBINATION BEVERAGE INSULATOR AND FLYING TOY

[75] Inventors: Douglas J. Malewicki, Irvine; Robert M. Kubinski, Mission Viejo, both of Calif.

[73] Assignee: Aero Visions Group, Irvine, Calif.

[21] Appl. No.: 190,884

[22] Filed: Feb. 3, 1994

[51] Int. Cl.[6] ..... A63H 27/00

[52] U.S. Cl. ..... 446/71; 446/34; 273/425

[58] Field of Search ..... 446/34, 36, 61, 68, 446/71, 73; 273/424, 425; 220/903

[56] References Cited

U.S. PATENT DOCUMENTS

| | | | |
|---|---|---|---|
| 2,683,603 | 7/1954 | Gackenbach | 273/106 |
| 3,264,776 | 8/1966 | Morrow | 446/34 |
| 3,982,489 | 9/1976 | Flatau et al. | 446/34 |
| 4,151,674 | 5/1979 | Klahn et al. | 446/34 |
| 4,246,721 | 1/1981 | Bowers | 273/425 |
| 4,291,117 | 5/1990 | Mucciarone | 220/903 |
| 4,383,422 | 5/1983 | Gordon et al. | 220/903 |
| 4,390,148 | 6/1983 | Cudmore | 273/425 |
| 4,534,391 | 8/1985 | Ventimiglia et al. | 220/903 |
| 4,671,424 | 6/1987 | Byrns | 220/903 |
| 4,790,788 | 12/1988 | Hill | 273/425 |
| 4,850,923 | 7/1989 | Etheridge | 273/424 |
| 5,067,922 | 11/1991 | McMahon | 446/71 |
| 5,152,709 | 10/1992 | Johnson et al. | 446/71 |

FOREIGN PATENT DOCUMENTS

| | | | |
|---|---|---|---|
| 2221292 | 1/1990 | United Kingdom | 220/903 |

*Primary Examiner*—Robert A. Hafer
*Assistant Examiner*—Jeffrey D. Carlson
*Attorney, Agent, or Firm*—Herbert M. Shapiro

[57] ABSTRACT

A combination flying toy/beverage can insulator comprising an insulating cylinder and weighted nose ring for fixing the center of gravity of the device at a point about 12% to 18% of the full length of the device distal from the leading edge of the device.

8 Claims, 5 Drawing Sheets

COMBINATION BEVERAGE INSULATOR AND FLYING TOY

FIELD OF THE INVENTION

This invention relates generally both to toys and insulators, and, more particularly, is directed towards a beverage container wrap insulator which doubles as a flying toy.

BACKGROUND OF THE INVENTION

The prior art includes several devices which function both as beverage holders and as flying toys. For example, a patent to McMahon, U.S. Pat. No. 5,067,922 teaches a cylindrical insulating container which can be used as a flying toy. The McMahon device includes separate inner and outer cylinders between which is sandwiched a weighted ring to provide aerodynamic stability. The patent to Johnson, U.S. Pat. No. 5,152,709 teaches a cylindrical insulator/flying toy including a nose element for locating the center of gravity between 25% and 38% from the leading edge of flight. Johnson also teaches the use of spokes in the inner space of the insulator. A patent to Hill, U.S. Pat. No. 4,790,788 teaches an aerial toy with a peripheral, though non-streamlined, ring at the leading edge with a ratio of leading edge weight to trailing edge weight resulting in a center of gravity located between 27.3% and 31% of the distance from front to back of the device. A patent to Morrow, U.S. Pat. No. 3,264,776 discloses a cylindrical aerial toy having weighted means such that the center of gravity is approximately ⅓ (33⅓%) of the distance from the front of the device to the rear of the device and achieving its aerodynamic properties, in part, from rotation in flight. Ethridge, U.S. Pat. No. 4,850,923 discloses a flying toy device in which the weight of the leading end portion to the weight of the trailing end portion is substantially equal to 2.5, that is the center of gravity is approximately 28.6% of the distance from the leading edge to the trailing edge. Other patents of interest are:

| Patentee | Patent No. |
|---|---|
| Miller | 5,099,898 |
| Gordon | 4,383,422 |
| Ventimiglia | 4,534,391 |
| Byrns | 4,671,424 |
| Cudmore | 4,390,148 |
| Klahn | 4,151,674 |
| Flatau | 3,982,489. |

If an axisymmetric throwing/flying toy is spun about its axis of symmetry, the gyroscopic effects will add to the stability of the device. This can make a normally unstable device stable. One example is a football which has its center of gravity at 50%. The devices of the prior art are normally statically unstable, having a combination of too much mass for the small aerodynamic stabilizing forces that can be generated, incorrect location of center of gravity and improper leading edge design. As a consequence, they cannot be stably projected without a high rate of spin. Because of the unique combination of shape and position of the center of gravity, the devices of the present invention, however, have strong built-in static stability which makes spin unnecessary.

The present invention is a combined ring wing/beverage container wrap insulator which exhibits superior static stability flying characteristics even when thrown with little or no spin. Its light weight and optimally fixed center of gravity thus make it particularly easy for children or persons unused to or unskilled at throwing to achieve very satisfying flight patterns. The soft front end and the low mass make the device significantly less dangerous on impacting people or objects. The device also floats well making it particularly suitable for use in water sports. It always floats high with its axis vertical so that it can be readily seen in the water. In addition, the device provides excellent insulation for the beverage can and holds the bottom of the beverage can off surfaces upon which the device is placed and thus acts as a coaster. In brief, the arrangements in accordance with the principles of the present invention exhibit a superior extended floating flight path, are easy to throw, are easy to catch, are light and unlikely to hurt an unprotected hand, have a desirable "squishy" feel, maintain a long flight path and are effective thermal insulators.

Other features and advantages of the present invention will become apparent from the following more detailed description, taken in conjunction with the accompanying drawings, which illustrate by way of example, the principles of the present invention.

BRIEF DESCRIPTION OF THE DRAWINGS

In the drawings, like reference numerals refer to like elements throughout the FIGURES.

DETAILED DESCRIPTION OF THE INVENTION

Figure 1:
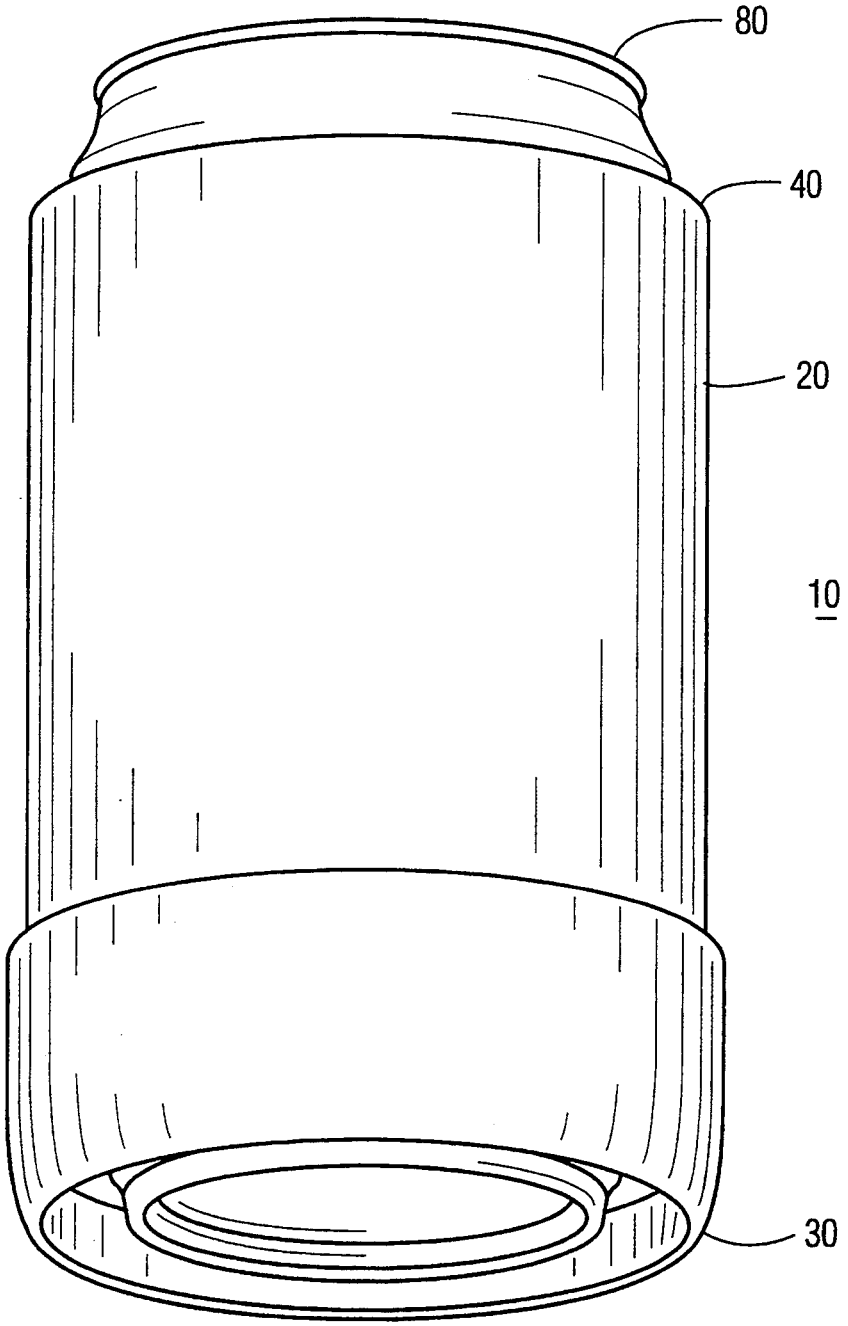
FIG. 1 is a perspective view of the invention, illustrating an aerodynamic sleeve in accordance with the principles of the present invention slip-fit around a conventional beverage container.
Figure 2:
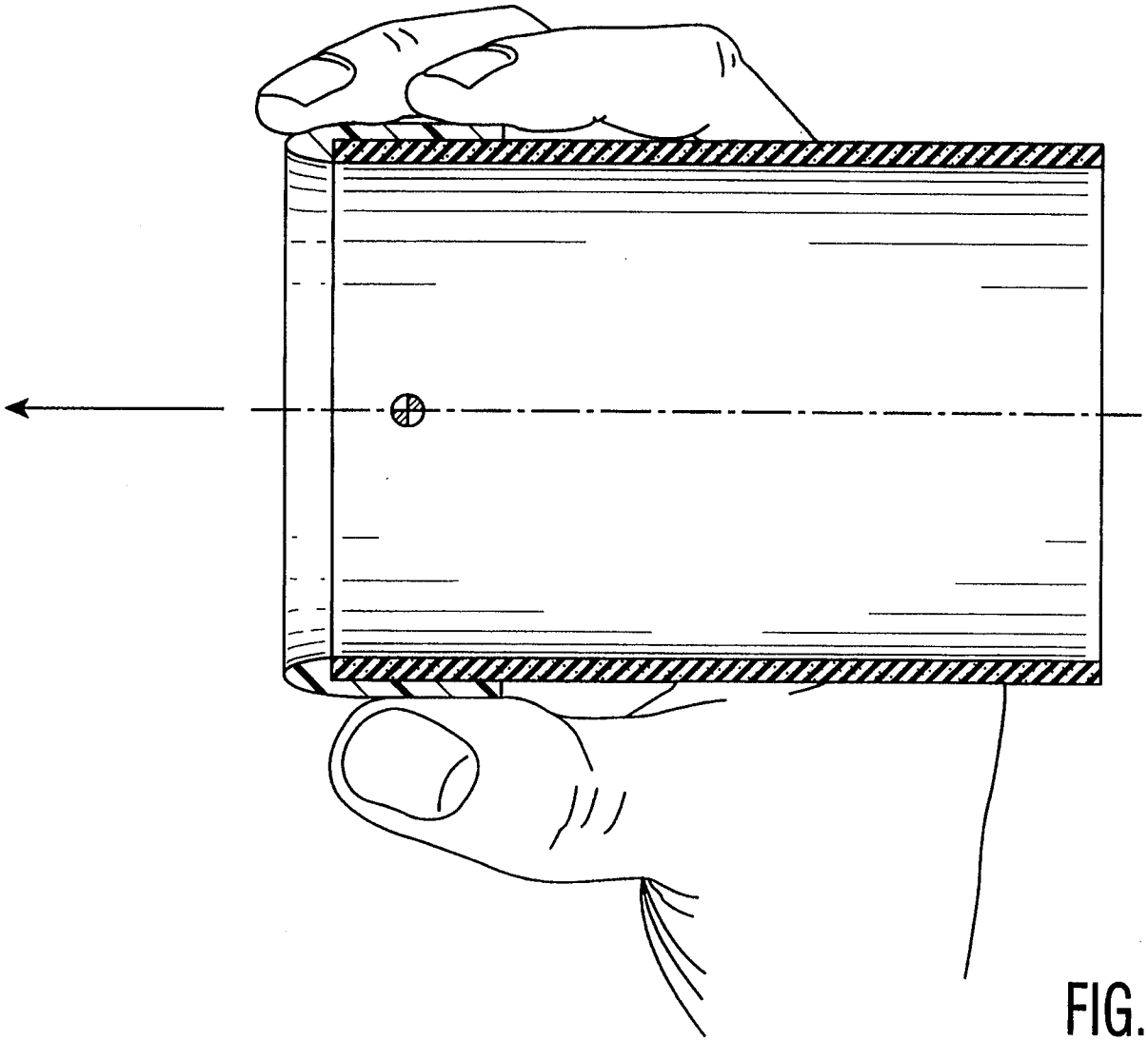
FIG. 2 illustrates a flying device constructed in accordance with the principles of the present invention as it might be propelled.
Figure 3D:
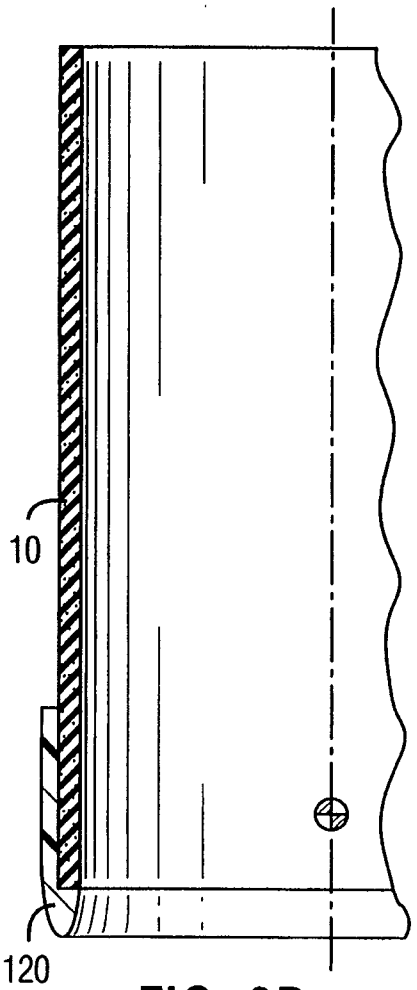
FIG. 3 is a series of partial cross-sectional views of the invention, illustrating different embodiments of the invention.
Figure 3C:
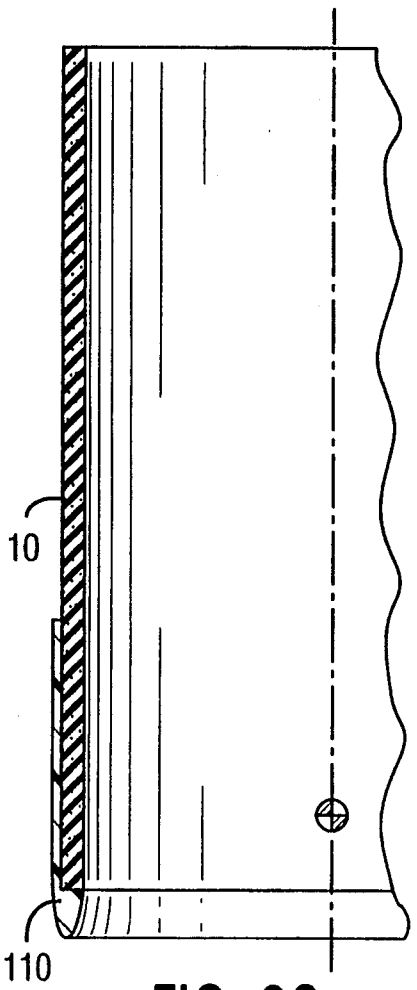
Figure 3B:
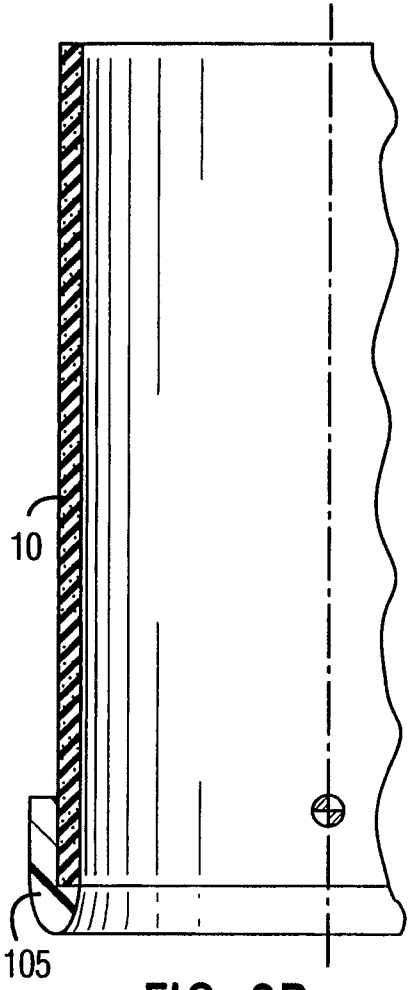
Figure 3A:
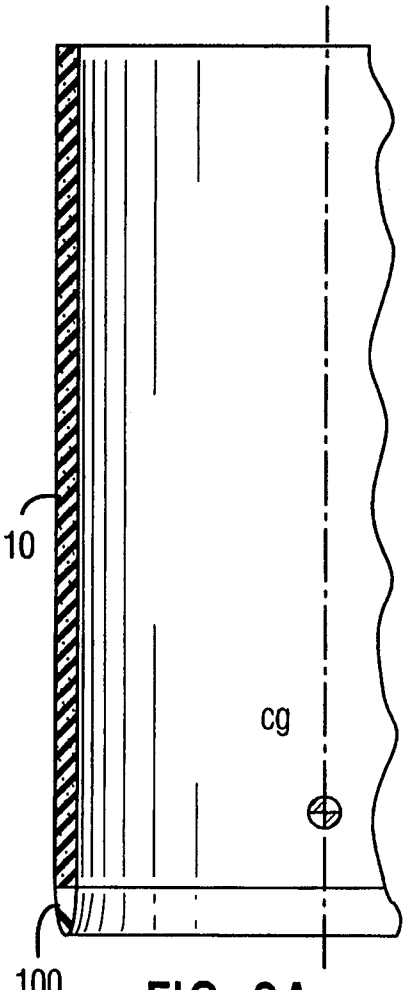

FIG. 1 shows a combination flying toy and beverage container insulator surrounding an aluminum beverage can 80. A cylindrical, insulating sleeve 10 made of a lightweight thermal insulating material has an annular side wall 20, a leading end 30 and a trailing end 40. Preferably, the insulating sleeve 10 is of unitary, one-piece construction and is fabricated from a lightweight foam, plastic or rubber material. Further, the leading end 30 is rounded and may further include a soft material bonded to sleeve 10, to prevent damage upon impact of sleeve 10 with other objects. The side wall 20 of sleeve 10 has an inner surface and an outer surface, each surface being cylindrical and mutually concentric. The inner surface provides a space for seating beverage container 80 in order to provide thermal insulation to beverage container 80. Preferably, the insulating sleeve 10 is formed so as to be a slip-fit around a standard aluminum beverage can and has a thickness of one-eighth inch for sleeves dimensioned to accept a beverage container. The inner diameter is approximately 70 mm and the ratio of length to inner diameter is 1.6 to 1.7. It is contemplated that the sleeve be launched by hand although other launching apparatus also may be employed. FIG. 2 illustrates a device constructed in accordance with the principles of the present invention as it might be held in preparation for use as a flying toy. As is clear from FIG. 2, the beverage can has been removed, the hand is typically placed near the leading edge of the device as shown and the device is to be launched in the direction of the arrow.

The outer surface of sleeve 10 may be used for advertising or may display other text or pictures. Alternatively, an outer sleeve of flexible, dimensionally stable material may be further included in contact with and fixed to outer surface of insulating sleeve 10. The outer sleeve provides means for stabilizing the outside diameter of sleeve 10. The outer sleeve may be a lightweight but strong sheet of material such as polyester sheet material.

In accordance with the principles of the present invention, leading edge 30 is weighted to achieve unique aerodynamic characteristics. The weighting mechanism is arranged to impart a unique center of gravity to the device. In particular, assuming the overall length of sleeve 10 is L and $X_{cg}$ is the distance of the center of gravity from leading edge 30 toward trailing edge 40, the distance as a percent of the length of sleeve 10 is defined as $\%cg=(X_{cg}/L)\times 100$. In accordance with the principles of the present invention, %cg is greater than 12% and less than 18%.

It is understood that there are a variety of designs which may be implemented which will result in a device in accordance with the principles of the present invention. FIG. 3 shows a sample of suitable designs. In the embodiment identified as "A" in FIG. 3, the weighting mechanism is a ring attached to the front of the device, nose ring 100. In order to achieve a center of gravity position in accordance with the principles of the invention, nose ring 100 must be relatively dense since the mass is concentrated in a small volume. In addition, the bonding surface is smaller making the product harder to manufacture and easier to break. Although this arrangement may be considered suitable in some cases, it generally makes for a less safe toy in that the front end of the device is necessarily more rigid. In addition, the gripping surface is softer and more flexible which makes it harder to throw. In embodiment "B" of FIG. 3, the weighting mechanism is more sleeve-like and is identified as nose ring 105. Nose ring 105 is an improvement over nose ring 100 because it provides a better gripping surface, however, for most applications, nose ring 105 is too stiff as a result of the thickness of the material of which it is constructed. In FIG. 3, embodiment "C" illustrates a nose ring approximating a sleeve, nose ring 110 which is also constructed in accordance with the principles of the present invention. Nose ring 110 provides a good gripping surface but, for most applications, the thin surface on the side of the device will be too flexible for optimum throwing characteristics. In addition, as the nose ring becomes thinner, molding becomes more difficult. Embodiment "D" of FIG. 3 shows a nose element, nose ring 120, which also provides a device having a center of gravity as defined by the invention as well as both an optimum compromise between rigidity and flexibility and a good gripping surface. Embodiment D has demonstrated superior flight characteristics.

Figure 4:
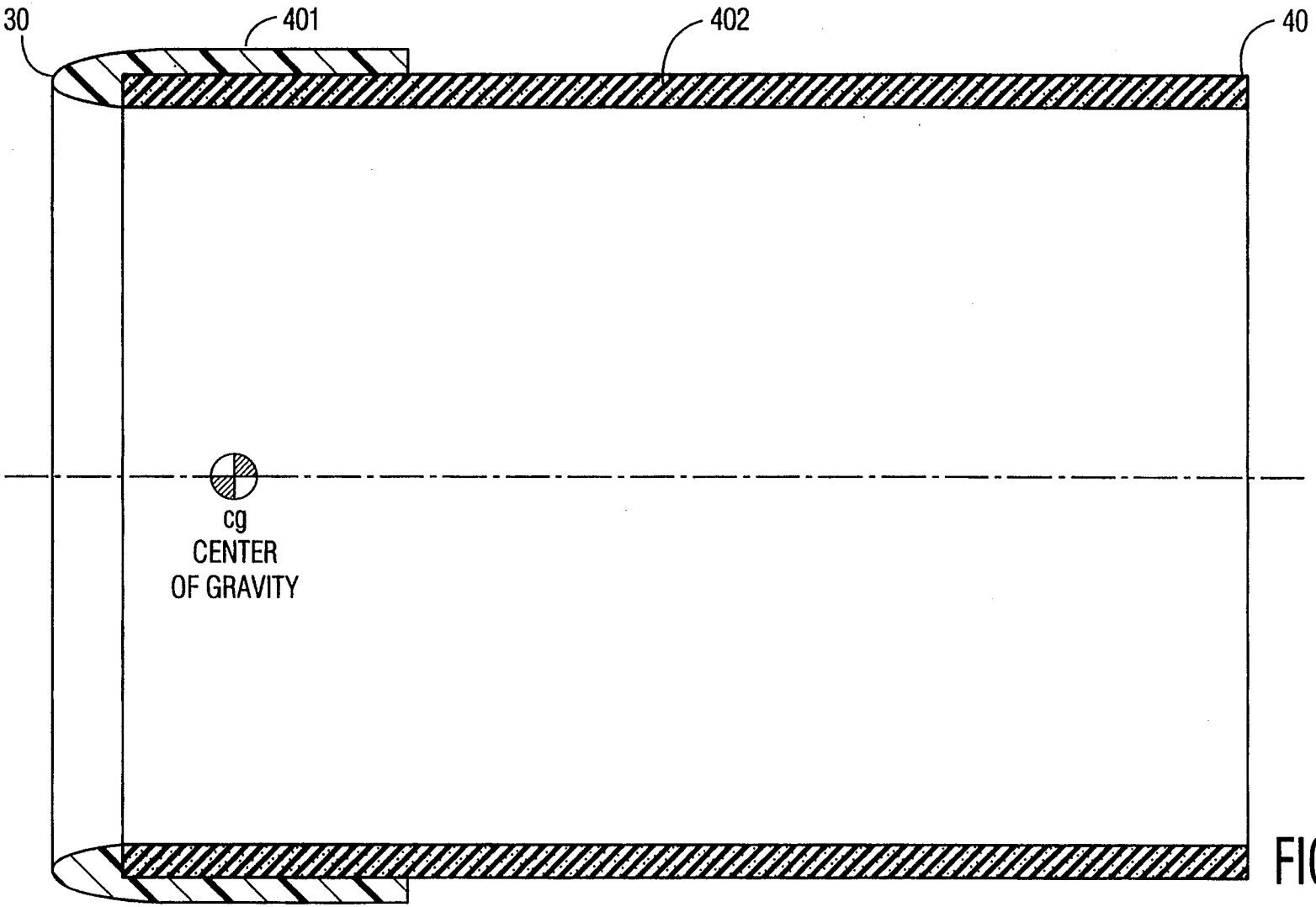
FIG. 4 shows in cross-sectional view a typical device including some physical dimensions constructed in accordance with the principles of the present invention.
Figure 5:
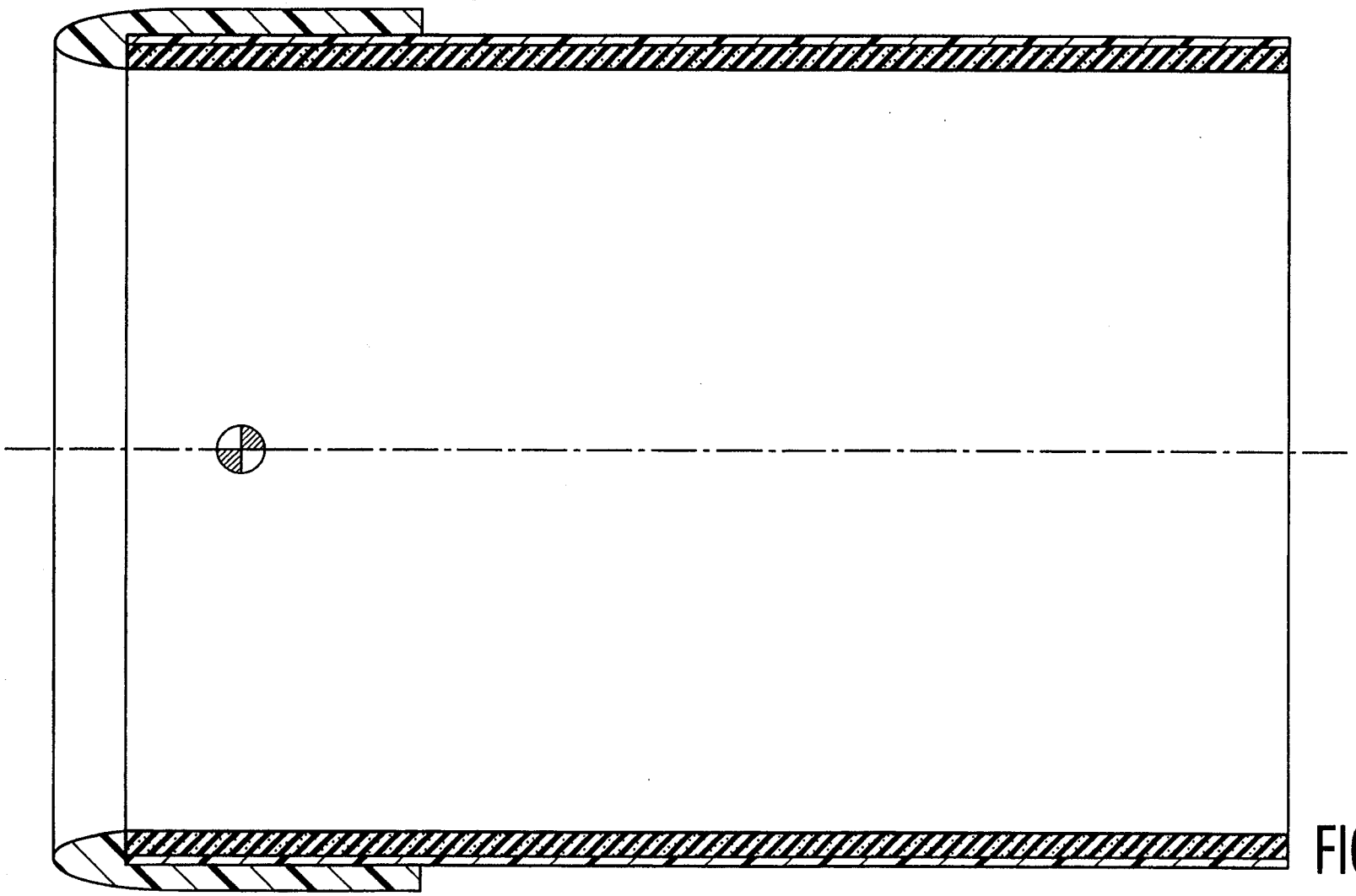
FIG. 5 illustrates embodiment with conjoined cylinders.

FIG. 4 shows in cross-sectional view a combination beverage can insulator and flying toy in accordance with the principles of the present invention and demonstrating excellent aerodynamic characteristics. In order to achieve rewarding gliding and flying characteristics, it is best to hold the device at the leading end and more particularly at nose ring 401 while throwing. For best results, one side of aerodynamic nose ring 401 should be gripped by the middle and index fingers. Consequently, the length of nose ring 401 from leading edge 30 toward trailing edge 40 is determined partially by the amount of surface available for holding the device during throwing. Anything less than one inch reduces gripping area and therefore reduces effective throwing power for most people. However, increasing the length of nose ring affects the placement of the center of gravity of the device. As described above, the optimum range for the center of gravity of the device is between 12% and 18% of the length of the device from leading end to trailing end. Thus, any portion of nose ring 401 extending beyond the desirable position of the center of gravity shifts the center of gravity toward the trailing end. For the illustrative embodiment shown in FIG. 4 and constructed of materials described above, a length for nose ring 401 of 1" to $1\frac{1}{8}$" gives good gripping space while maintaining a good center of gravity distance ratio. Of course, if nose ring 401 were made thicker, in order to maintain the appropriate center of gravity distance, the length of nose ring 401 would have to be reduced thereby reducing the gripping area.

The embodiment of FIG. 4 shows an insulating tube 402, illustratively of a material such as polystyrene having the desired rigidity, lightness and low thermal conductivity and nose ring 401 as separate elements. Although the rearward extreme of nose ring 401 extends outward from the device, in this arrangement, no substantial deterioration in the aerodynamic characteristics of the device are introduced as long as the step between insulating wall 402 and the outer diameter of nose ring 401 does not exceed approximately 6–7% of the outer diameter of the device.

The weighting mechanism in the arrangement of FIG. 4 is an aerodynamic nose ring 401 which may be an injection molded low density polyethylene. Insulating tube 402 may be a polyolefin extruded sheet material. It has been determined that 2 pound per cubic foot, closed cell, cross-linked, irradiated polyolefin extruded sheet stock of an extremely fine and smooth grain structure provides excellent insulating and support properties. The total length of the sleeve is not critical to the invention and the length specified in FIG. 4 was selected at about 88% (or 4.25") of the length of a standard beverage can to allow a margin at the top to permit a person to drink directly from the can without interference from the sleeve. The thickness of the sleeve is 4% to 5% of the inner diameter and the combined weight of the cylinder and the weighting means is 15 g to 18 g.

While the invention has been described in connection with illustrative embodiments, it is not intended to limit the scope of the invention to the particular form set forth but it is intended to cover such alternatives, modifications and equivalents as may be included by the appended claims.

What is claimed is:

1. A flying device comprising an open-ended axisymmetric cylinder means of an insulating material for thermally insulating a beverage container said cylinder having a leading end and a trailing end, and weighting means proximal to the leading end of said cylinder means for enhancing the aerodynamic qualities of said device and wherein said device is characterized in that said weighting means fixes the center of gravity of said device in the range from 12–18% of the distance from said leading edge of said device to the trailing end of said device.

2. A device as in claim 1 wherein said weighting means comprises a nose ring of a soft, highly flexible plastic material and wherein said nose ring is arranged to form a close fit over said cylinder means leading end.

3. A device as in claim 1 wherein said weighting means comprises an annular ring bonded to said cylinder means insulating material.

4. A device as in claim 1 wherein said weighting means comprises a ring of substantially annular shape and fixed to the outer surface of said cylinder means.

5. A device as in claim 2 wherein said cylinder means has a ratio of axial length to inner diameter in the range 1.6 to 1.7 and wherein said cylinder means has a thickness in the range 4% to 5% of the inner diameter of said cylinder means.

6. A device as in claim 4 wherein said cylinder means inner diameter is approximately 70 mm and wherein the confined weight of said cylinder means and said weighting means is in the range of 15 to 18 grams.

7. A device for thermally insulating a beverage container and for operating as an aerial toy comprising a first open-ended cylinder means of an insulating material capable of thermally insulating said beverage container, a second open-ended cylinder means for providing rigidity wherein said first cylinder is joined about its outer surface to the inside surface of said second cylinder, and wherein said first and second conjoined cylinders have a leading end and a trailing end, and weighting means proximal to said leading end of said first and second conjoined cylinders for providing aerodynamic stability to said device wherein said weighting means is arranged to fix the center of gravity of said device in the range from 12–18% of the distance from said leading end to said trailing end of said conjoined cylinders.

8. A device as in claim 7 wherein said weighting means comprises an approximately annular ring having a J-shaped cross-section and wherein said weighting means is fitted over and attached to the leading end of said cylinder.

* * * * *